US008717256B2

(12) United States Patent
Park

(10) Patent No.: US 8,717,256 B2
(45) Date of Patent: May 6, 2014

(54) ORGANIC LIGHT EMITTING DISPLAY DEVICE WITH AN INPUT VOLTAGE CONTROLLED IN ACCORDANCE WITH AN OFFSET CONTROL SIGNAL

(75) Inventor: Sung-Un Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 812 days.

(21) Appl. No.: 12/467,144

(22) Filed: May 15, 2009

(65) Prior Publication Data

US 2009/0309817 A1 Dec. 17, 2009

(30) Foreign Application Priority Data

Jun. 16, 2008 (KR) ..... 10-2008-0056253

(51) Int. Cl.
*G09G 3/30* (2006.01)

(52) U.S. Cl.
USPC ..... 345/76; 345/211

(58) Field of Classification Search
USPC ..... 345/52, 76, 77, 204, 211, 212, 214; 315/169.2, 169.3
See application file for complete search history.

(56) References Cited

U.S. PATENT DOCUMENTS

2005/0110420 A1* 5/2005 Arnold et al. ..... 315/169.3
2006/0001613 A1* 1/2006 Routley et al. ..... 345/76
2006/0007248 A1* 1/2006 Reddy et al. ..... 345/690
2006/0267507 A1* 11/2006 Cho ..... 315/169.2
2007/0024565 A1* 2/2007 Choi ..... 345/98
2007/0182672 A1* 8/2007 Hoppenbrouwers et al. ... 345/76
2007/0182870 A1* 8/2007 Lee ..... 348/790
2008/0007442 A1* 1/2008 Oprescu ..... 341/155
2008/0266216 A1* 10/2008 Choi ..... 345/77
2008/0316157 A1* 12/2008 Park et al. ..... 345/89

FOREIGN PATENT DOCUMENTS

JP 2007-171949 7/2007
KR 10-2006-0038847 5/2006
KR 10-2006-0039987 5/2006
KR 10-2007-0000824 1/2007
KR 10-2008-0082281 9/2008
KR 10-2008-0083883 9/2008
KR 10-2008-0084150 9/2008

OTHER PUBLICATIONS

KIPO Office action dated Mar. 19, 2010, for priority Korean Patent application 10-2008-0056253.

* cited by examiner

*Primary Examiner* — Pegeman Karimi
(74) *Attorney, Agent, or Firm* — Christie, Parker & Hale, LLP

(57) ABSTRACT

An organic light emitting display device capable of maintaining a voltage of a driving power of a display panel in a substantially constant manner. The organic light emitting display device includes a display panel for receiving an image data and an input voltage to display an image; a driving IC for supplying the image data to the display panel, receiving the input voltage, and outputting an offset control signal in accordance with the received input voltage; and a power supply for controlling the input voltage in accordance with the offset control signal, and supplying the controlled input voltage to the display panel.

9 Claims, 2 Drawing Sheets

ORGANIC LIGHT EMITTING DISPLAY DEVICE WITH AN INPUT VOLTAGE CONTROLLED IN ACCORDANCE WITH AN OFFSET CONTROL SIGNAL

CROSS-REFERENCE TO RELATED APPLICATIONS

This application claims priority to and the benefit of Korean Patent Application No. 10-2008-0056253, filed on Jun. 16, 2008, in the Korean Intellectual Property Office, the entire content of which is incorporated herein by reference.

BACKGROUND

1. Field of the Invention

The present invention relates to an organic light emitting display device, and, more particularly, to an organic light emitting display device capable of maintaining a voltage of a driving power of a display panel in a substantially constant manner.

2. Discussion of Related Art

Recently, studies have been made to develop organic light emitting display devices which can be thin and light, can have fast response speed, and can be driven with low power consumption.

An organic light emitting display device is a flat panel display device that displays images using an organic light emitting diode for generating light through the recombination of electrons and holes.

Such an organic light emitting display device includes a display panel for displaying images, a power supply for supplying driving power to the display panel, and a driving integrated circuit (IC) for supplying driving signals to the display panel.

However, in the organic light emitting display device, the luminance of an image may be changed depending on the voltage of the driving power. That is, the voltage distribution of the driving power supplied to the display panel of the organic light emitting display device is linked to the luminance distribution of the image displayed in the display panel.

Therefore, in order to display a proper image, the voltage of the driving power provided to the display panel should be maintained in a substantially constant manner.

SUMMARY OF THE INVENTION

An aspect of an embodiment of the present invention is directed toward an organic light emitting display device capable of maintaining a voltage of a driving power of a display panel in a substantially constant manner.

According to an embodiment of the present invention, an organic light emitting display device includes: a display panel (e.g., an organic light emitting display panel) for receiving an image data and an input voltage to display an image; a driving integrated circuit (IC) for supplying the image data to the display panel, receiving the input voltage, and outputting an offset control signal in accordance with the received input voltage; and a power supply for controlling the input voltage in accordance with the offset control signal, and supplying the controlled input voltage to the display panel.

Here, the driving IC may include an input voltage detector for detecting the input voltage; and an offset comparator for comparing the voltage value of the input voltage with a set voltage value, and outputting the offset control signal to the power supply in accordance with the compared result. The driving IC may further include a check-sum unit for outputting a clock signal for controlling the offset comparator in accordance with a write command from a host.

Further, the power supply may include an offset controller for detecting the offset control signal to output a reference voltage control signal; a reference voltage controller for controlling a reference voltage in accordance with the reference voltage control signal; a feedback circuit unit for controlling an output voltage of the power supply in accordance with the reference voltage; and a booster unit for boosting the output voltage to output the boosted output voltage as the input voltage of the display panel.

As described above, according to embodiments of the present invention, a reference voltage is controlled by detecting a voltage (i.e., an input voltage) of a driving power inputted to an input terminal of a display panel, so that the input voltage can be maintained in a substantially constant manner. Accordingly, luminance variations of an image can be minimized or reduced to display a proper image.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
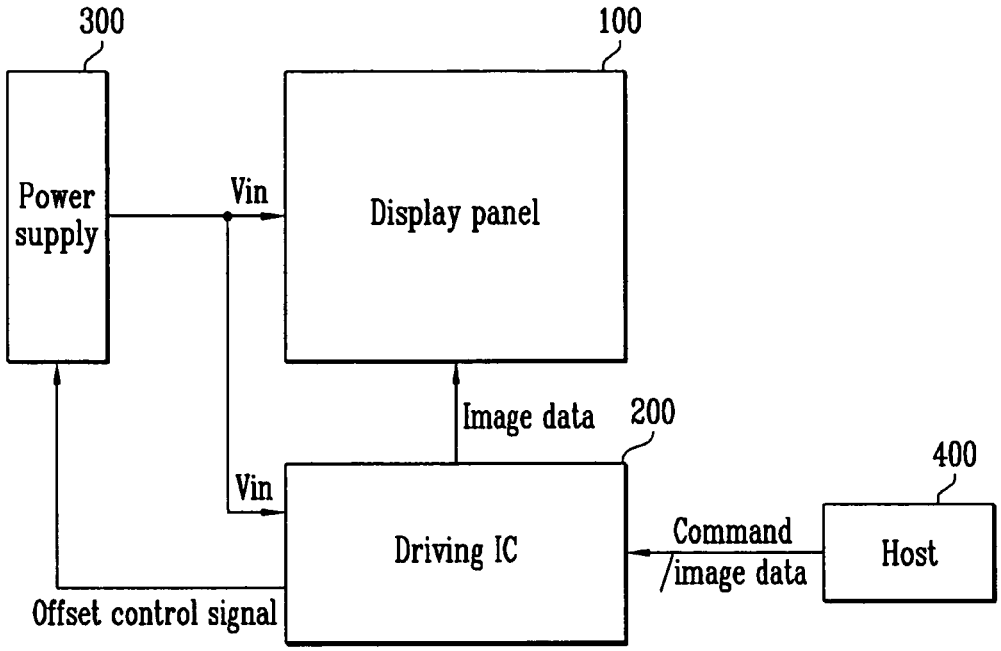
FIG. 1 is a schematic block diagram of an organic light emitting display device according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

FIG. 1 is a schematic block diagram of an organic light emitting display device according to an embodiment of the present invention.

Referring to FIG. 1, the organic light emitting display device includes a display panel (e.g., an organic light emitting display panel) 100, a driving integrated circuit (IC) 200 and a power supply 300.

The display panel 100 displays an image in accordance with both an image data supplied from the driving IC 200, and a voltage (hereinafter, referred to as an "input voltage Vin") of a driving power supplied from the power supply 300. In addition, the display panel 100 includes a plurality of pixels, each of the pixels having at least one organic light emitting diode.

The driving IC 200 supplies an image data and/or various suitable driving signals in accordance with a command and/or an image data supplied from a host 400. For example, if a scan driver and/or a data driver are mounted in the display panel 100, the driving IC 200 supplies driving signals to drive the scan driver and/or the data driver and supplies the image data supplied from the host 400 to the display panel 100.

Meanwhile, in an embodiment of the present invention, the driving IC 200 receives an input voltage Vin that is also inputted to an input terminal of the display panel 100, generates an offset control signal in accordance with the input voltage, and outputs the generated offset control signal to the power supply 300.

The power supply 300 supplies a driving power to drive the display panel 100. However, in an embodiment of the present invention, the power supply 300 controls an output voltage of the driving power in accordance with the offset control signal supplied from the driving IC 200, so that the input voltage Vin supplied to the display panel 100 is maintained at a set value.

Here, the voltage outputted from the power supply 300 is the input voltage Vin inputted to the display panel 100. Therefore, the voltage outputted from the power supply 300 should ideally be equal to the input voltage Vin. However, the voltage outputted from the power supply 300 is usually different from the input voltage Vin due to a load of the transmission wires. As such, the luminance of the display panel 100 can change depending on the input voltage Vin (i.e., an input voltage such as ELVDD). Therefore, in the embodiment of the present invention, the power supply 300 is controlled based on the input voltage Vin.

As described above, in the embodiment of the present invention, the input voltage Vin is maintained in a substantially constant manner by utilizing a feedback for detecting the input voltage Vin inputted to the input terminal of the display panel 100 and controlling a voltage outputted from an output terminal of the power supply 300 according to the input voltage Vin.

Accordingly, a proper (or optimal) image can be displayed by minimizing or reducing luminance variations of an image due to the input voltage Vin regardless of a characteristic distribution of the power supply 300 and/or a load of the display panel 100.

In view of the foregoing, an organic light emitting display device has been described as an example of the present invention. However, the present invention is not limited thereto. That is, the technical scope of the present invention may be applied to various other types of suitable flat panel display devices.

Figure 2:
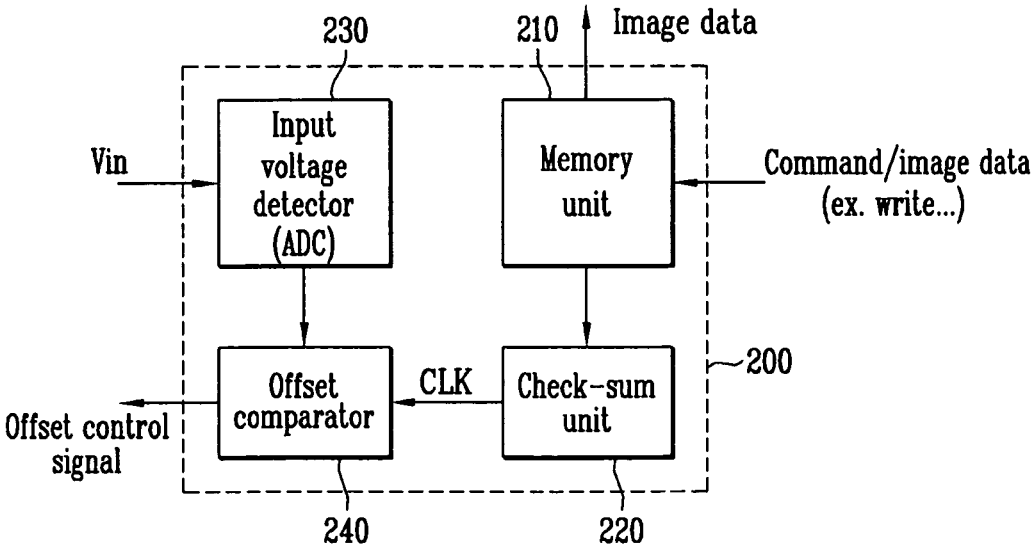
FIG. 2 is a schematic block diagram showing an embodiment of a driving IC shown in FIG. 1.

FIG. 2 is a schematic block diagram showing an embodiment of the driving IC shown in FIG. 1.

Referring to FIG. 2, the driving IC 200 includes a memory unit 210, a check-sum unit 220, an input voltage detector 230 and an offset comparator 240.

The memory unit 210 includes a memory and/or a register for storing a command and/or an image data inputted from an external device, such as the host 400. Here, the image data inputted to the memory unit 210 is check-summed in the check-sum unit 220 to test whether or not an error has occurred, and then the check-summed image data is supplied to the display panel 100.

The check-sum unit 220 tests whether or not an error of the image data stored in the memory unit 210 has occurred, and also outputs a clock signal CLK for controlling the offset comparator 240 in accordance with the command inputted from the host 400. For example, the check-sum unit 220 may recognize a write command inputted from the host 400 by referring to the memory unit 210 and may output a clock signal CLK to be synchronized with the write command.

The input voltage detector 230 detects the amplitude of an input voltage Vin inputted through the input terminal of the display panel 100. Here, the input voltage detector 230 may include an analog-to-digital converter (ADC) for receiving the input voltage Vin and for converting the input voltage Vin into a digital signal.

The offset comparator 240 compares the voltage value of the input voltage Vin detected by the input voltage detector 230 with a previously set and stored voltage value (comparison value), and outputs an offset control signal in accordance with the compared result. Here, the previously stored voltage value is set to be an ideal voltage value that should be inputted to the display panel 100 so as to display a proper (or optimal) image.

More specifically, the offset comparator 240 detects an offset value in accordance with a difference between the voltage value of the input voltage Vin and the previously stored voltage value, and outputs the offset value to the power supply 300 through an offset control signal.

As an example, assume that the voltage value of the input voltage Vin and the previously stored voltage value are 4.62V and 4.6V, respectively, and the resolution of the ADC is 10 mV. In this case, the offset comparator 240 may detect a value "2" obtained by dividing 20 mV that is the difference between 4.62V and 4.60V by 10 mV that is the resolution of the ADC.

Such an offset value is provided to the power supply 300 through an offset control signal to control a reference voltage of the power supply 300. Here, the offset control signal may be an offset value itself or a conversion signal converted to correspond to the offset value.

In addition, the operation of the offset comparator 240 is controlled by a clock signal CLK supplied from the check-sum unit 220.

For example, the offset comparator 240 maintains a previous data until a clock signal CLK is supplied from the check-sum unit 220 in accordance with a write command inputted from the host 400, and outputs an offset control signal when the clock signal CLK is supplied, thereby controlling the power supply 300.

As described above, the driving IC 200 outputs an offset control signal in accordance with an input voltage Vin to control the power supply 300. Accordingly, the driving IC 200 controls the power supply 300 to supply a substantially constant input voltage Vin to the display panel 100.

Figure 3:
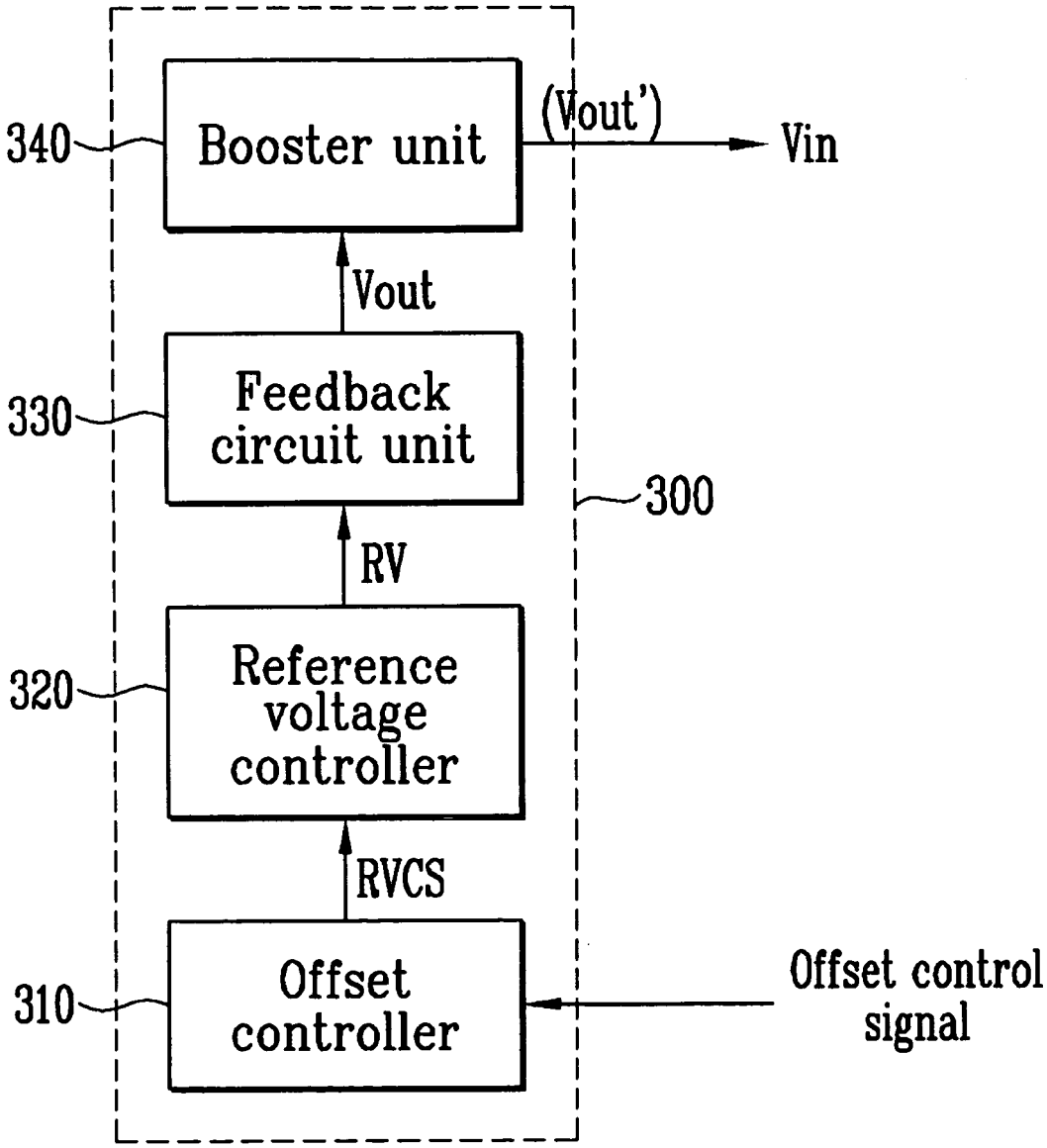
FIG. 3 is a schematic block diagram showing an embodiment of a power supply shown in FIG. 1.

FIG. 3 is a schematic block diagram showing an embodiment of the power supply shown in FIG. 1.

Referring to FIG. 3, the power supply 300 includes an offset controller 310, a reference voltage controller 320, a feedback circuit unit 330 and a booster unit 340.

The offset controller 310 detects an offset control signal supplied from the driving IC 200 and outputs a reference voltage control signal RVCS in accordance with the offset control signal. Here, the reference voltage control signal RVCS may be an offset control signal itself or a conversion signal converted to correspond to the offset control signal.

The reference voltage controller 320 controls a reference voltage RV of the feedback circuit unit 330 to correspond to the reference voltage control signal RVCS outputted from the offset controller 310.

The feedback circuit unit 330 outputs an output voltage Vout of the power supply 300 to correspond to the reference voltage RV controlled by the reference voltage controller 320.

The booster unit 340 boosts the output voltage Vout outputted from the feedback circuit unit 330 and outputs the boosted output voltage Vout' to the output terminal of the power supply 300.

The boosted output voltage Vout' is inputted as an input voltage Vin through the input terminal of the display panel 100. The input voltage Vin is also inputted to the driving IC 200 to be used in generating an offset control signal.

As described above, the power supply 300 receives an offset control signal generated from the driving IC 200 to correspond to an input voltage Vin and controls an output voltage Vout accordingly. Consequently, the power supply 300 controls an output voltage Vout in a feedback manner, so that an input voltage Vin inputted to the display panel 100 is maintained in a substantially constant manner.

Particularly, in an embodiment of the present invention, an output voltage Vout of the power supply 300 is controlled to correspond to an input voltage measured at the input terminal of the display panel 100, in consideration of a voltage drop between the power supply 300 and the display panel 100. Accordingly, a luminance variation of an image due to a variation of an input voltage can be minimized or reduced to display a proper (or optimal) image.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device, comprising:

a display panel for receiving an image data and an input voltage and displaying an image in accordance with the image data and the input voltage;

a driving integrated circuit (IC) for supplying the image data to the display panel, receiving the input voltage, and outputting an offset control signal in accordance with the received input voltage; and a power supply for controlling the input voltage in accordance with the offset control signal, and supplying the controlled input voltage to the display panel, wherein the driving IC comprises:

an input voltage detector for detecting the input voltage;

an offset comparator for comparing a voltage value of the input voltage with a set voltage value to provide a compared result, and outputting the offset control signal to the power supply in accordance with the compared result; and a check-sum unit for outputting a clock signal for controlling the offset comparator in accordance with a write command from a host.

2. The organic light emitting display device as claimed in claim 1, wherein the input voltage detector comprises an analog-to-digital converter (ADC) for converting the input voltage into a digital signal.

3. The organic light emitting display device as claimed in claim 1, wherein the offset comparator outputs a difference between the voltage value of the input voltage and the set voltage value to the power supply through the offset control signal.

4. The organic light emitting display device as claimed in claim 1, wherein the power supply comprises:

an offset controller for detecting the offset control signal and outputting a reference voltage control signal in accordance with the offset control signal;

a reference voltage controller for controlling a reference voltage in accordance with the reference voltage control signal;

a feedback circuit unit for controlling an output voltage of the power supply in accordance with the reference voltage; and a booster unit for boosting the output voltage and outputting a boosted output voltage as the input voltage of the display panel.

5. A display device, comprising:

a light emitting display panel for receiving an image data and an input voltage and displaying an image in accordance with the image data and the input voltage;

a driving integrated circuit (IC) for supplying the image data to the light emitting display panel, receiving the input voltage, and outputting an offset control signal in accordance with the received input voltage;

a power supply for controlling the input voltage in accordance with the offset control signal, and supplying the controlled input voltage to the light emitting display panel, wherein the driving IC comprises:

an input voltage detector for detecting the input voltage;

an offset comparator for comparing a voltage value of the input voltage with a set voltage value to provide a compared result, and outputting the offset control signal to the power supply in accordance with the compared result; and a check-sum unit for outputting a clock signal for controlling the offset comparator in accordance with a write command from a host.

6. The display device as claimed in claim 5, wherein the input voltage detector comprises an analog-to-digital converter (ADC) for converting the input voltage into a digital signal.

7. The display device as claimed in claim 5, wherein the offset comparator outputs a difference between the voltage value of the input voltage and the set voltage value to the power supply through the offset control signal.

8. The display device as claimed in claim 5, wherein the power supply comprises:

an offset controller for detecting the offset control signal and outputting a reference voltage control signal in accordance with the offset control signal;

a reference voltage controller for controlling a reference voltage in accordance with the reference voltage control signal;

a feedback circuit unit for controlling an output voltage of the power supply in accordance with the reference voltage; and a booster unit for boosting the output voltage and outputting a boosted output voltage as the input voltage of the display panel.

9. The display device as claimed in claim 5, wherein the light emitting display panel is an organic light emitting display panel.

* * * * *